US006783259B1

(12) United States Patent
Macedonio

(10) Patent No.: US 6,783,259 B1
(45) Date of Patent: Aug. 31, 2004

(54) APPARATUS FOR RECREATING AND ILLUMINATING A VISUAL IMAGE

(76) Inventor: Anthony Macedonio, 8 Hazel St., Glen Cove, NY (US) 11542

( * ) Notice: Subject to any disclaimer, the term of this patent is extended or adjusted under 35 U.S.C. 154(b) by 0 days.

(21) Appl. No.: 10/200,389

(22) Filed: Jul. 22, 2002

(51) Int. Cl.[7] ..... F21V 23/04

(52) U.S. Cl. ..... 362/251; 362/806; 362/812; 362/234; 362/252

(58) Field of Search ..... 362/251, 252, 362/253, 806, 807, 808, 812, 234, 249; 40/541; 116/173

(56) References Cited

U.S. PATENT DOCUMENTS

| | | | | |
|---|---|---|---|---|
| 1,719,715 A | | 7/1929 | Monk | 362/249 |
| 1,771,444 A | | 7/1930 | Monk | 362/806 |
| 1,976,964 A | | 10/1934 | Propp | 362/806 |
| 2,717,336 A | | 9/1955 | Craddock | 315/183 |
| 3,204,090 A | | 8/1965 | Kvarda, Jr. | 240/10 |
| 3,692,993 A | | 9/1972 | Robinson | 240/10 |
| 3,789,211 A | | 1/1974 | Kramer | 240/10 |
| 3,944,878 A | | 3/1976 | Gerontakis | 315/185 |
| 5,161,882 A | | 11/1992 | Garrett | 362/249 |
| 5,245,519 A | | 9/1993 | Openiano | 362/252 |
| 5,345,147 A | | 9/1994 | Wu | 315/185 |
| 5,570,946 A | * | 11/1996 | Chien | 362/84 |
| 5,575,098 A | | 11/1996 | Goettel-Schwartz | 40/550 |
| 5,857,763 A | * | 1/1999 | Chen | 362/140 |
| 6,402,336 B1 | * | 6/2002 | Reese | 362/103 |
| 6,455,767 B1 | * | 9/2002 | Muller | 136/245 |
| 2001/0053076 A1 | * | 12/2001 | Chien | 362/84 |

* cited by examiner

*Primary Examiner*—Alan Cariaso
*Assistant Examiner*—Mark Tsidulko
(74) *Attorney, Agent, or Firm*—Michael I. Kroll

(57) ABSTRACT

An apparatus for recreating and simultaneously illuminating the visual features of a substantially planar visual image using illumination devices, the United States flag being a visual image utilized in one embodiment.

7 Claims, 17 Drawing Sheets

APPARATUS FOR RECREATING AND ILLUMINATING A VISUAL IMAGE

FIELD OF THE INVENTION

The present invention relates generally to lighting displays and, more specifically, to a method and apparatus for illuminating a flag.

DESCRIPTION OF THE PRIOR ART

There are other display illumination device designed for novelty items. Typical of these is U.S. Pat. No. 1,719,715 issued to Monk on Jul. 2, 1929.

Another patent was issued to Monk on Jul. 29, 1930 as U.S. Pat. No. 1,771,444. Yet another U.S. Pat. No. 1,976,964 was issued to Propp on Oct. 16, 1934 and still yet another was issued on Sep. 6, 1955 to Craddock as U.S. Pat. No. 2,717,336.

Another patent was issued to Kvada, Jr. on Aug. 31, 1965 as U.S. Pat. No. 3,204,090. Yet another U.S. Pat. No. 3,692,993 was issued to Robinson on Sep. 19, 1972. Another was issued to Kramer on Jan. 29, 1974 as U.S. Pat. No. 3,789,211 and still yet another was issued on Mar. 16, 1976 to Gerontakis as U.S. Pat. No. 3,944,878.

Another patent was issued to Garrett on Nov. 10, 1992 as U.S. Pat. No. 5,161,882. Yet another U.S. Pat. No. 5,245,519 was issued to Openiano Sep. 14, 1993. Another was issued to Wei-Kuo Wu on Sep. 6, 1994 as U.S. Pat. No. 5,345,147 and still yet another was issued on Nov. 19, 1996 to Goettel-Schwartz as U.S. Pat. No. 5,575,098.

U.S. Pat. No. 1,719,715

Inventor: Sidney J. Monk

Issued: Jul. 2, 1929

The present invention relates to means for artistically illuminating windows and the like at Christmas time or on other festive occasions, the object being to provide an exceedingly simple structure, involving electric lamp-holding means of a novel character that can constitute an article of manufacture in itself, and with which can be used standard electrical equipment, such as that employed for Christmas tree illumination.

U.S. Pat. No. 1,771,444

Inventor: Sidney J. Monk

Issued: Jul. 29, 1930

The present invention is a simple, safe, inexpensive and practible device that can be mounted on a window and will produce an artistic illumination thereof. The device is comprised of a supporting bar for location in a window frame alongside the inner side of the sash, a plurality of lamp holders carried by the bar, plates located over the top of the bar and having terminal portions that engage behind adjacent portions of the window structure to hold the bar against the inner side of the sash, and means for suspending the underlying bar from the overlying plates.

U.S. Pat. No. 1,976,964

Inventor: Louis Propp

Issued: Oct. 16, 1934

The invention is an illumination unit comprising an elongated base made of sheet material having a pair of aligned top wall portions, a pair of vertical portions extending downwardly from the inner ends of said top wall portions, said vertical portions being interconnected at the bottom and forming an elongated channel, said top wall portions, vertical portions and interconnecting portion being cut away to form openings in the top of the base a plurality of tubular vertical members mounted on said base and having the lower end thereof inserted in said openings, sockets attached to the upper ends of said tubular members, said sockets being wired in series circuit, said wiring extending within said tubular members through the bottom open ends thereof and within said channel, and a removable bottom cover for said base.

U.S. Pat. No. 2,717,336

Inventor: Charles L. Craddock

Issued: Sep. 6, 1955

Shown is a flasher circuit of the class described which includes: a conductive device having the electrical characteristics of a glow discharge device; a control circuit comprising a resistor and a capacitor connected in parallel; a power utilization device connected in series with said conductive device; a reinforcing capacitor connected in parallel with the series circuit comprising said conductive device and said utilization device, forming a first series-parallel circuit; means connecting said control circuit in series with said first series-parallel circuit to form a second series-parallel circuit; a power capacitor connected in parallel with said series-parallel circuit to form a network; and a resistor connected in series with said network and through which said network is adapted to be connected to a source of electrical energy.

U.S. Pat. No. 3,204,090

Inventor: Charles Kvarda, Jr.

Issued: Aug. 31, 1965

Disclosed is an apparatus for holding a string of decorative lights spaced apart in a line and connected by a wiring circuit comprising an elongated thin-wall channel, said channel having a web and a pair of legs, a bent portion formed on the end of said legs throughout their lengths and parallel to the web, said bent portions confronting each other respectively to provide books for use in supporting said apparatus, said web being perforated to provide spaced openings throughout its length intermediate said legs, said perforations receiving electrical lamps secured in sockets, one of said legs being perforated proximate to each end respectively, fittings in engagement with said perforations in the leg, and hooks in engagement with the fittings, said hooks supporting the apparatus, said lamps being exterior of said channel and said wiring and sockets being retained in said channel means on the opposite side of said web from said lamps.

U.S. Pat. No. 3,692,993

Inventor: Samuel H. Robinson

Issued: Sep. 19, 1972

A lighting fixture unit having a housing adapted to be mounted on a building or similar structure, the housing having an opening in a wall on which a door is mounted for movement between open and closed positions. Electric lights are carried in a holder which is swingable in the housing for moving the lights between a hidden portion in the housing and an exposed position extending through the opening.

U.S. Pat. No. 5,345,147

Inventor: Norman Kramer

Issued: Jan. 29, 1994

A multi-channel lighting system which includes a lamp load for each channel. Each channel is a nominally identical self-modulating half-wave phase control circuit employing DC feedback to modify both reference and pedestal levels in a dual frequency oscillator. The result is a random off and on pattern for each channel. Each lamp load is a different color which produces a random and dynamic color light display in response to each channel for decorating Christmas trees or the like.

U.S. Pat. No. 3,944,878

Inventor: Basil G. Gerontakis

Issued: Mar. 16, 1976

A sequential light flashing circuit usable as a decorative display for Christmas decorations or the like includes a switching circuit for energizing lights in a predetermined sequence to provide a variety of distinct light patterns. A thyristor brightness control circuit is employed in conjunction with the sequential switching circuit to vary the brightness of each light during its operating interval. The operation of the sequential switching circuit may be stopped at any desired point to permit any light pattern in the sequence to be continuously displayed.

U.S. Pat. No. 5,161,882

Inventor: Joe L. Garrett

Issued: Nov. 10, 1992

A unitary housing includes a plurality of spaced sockets therewithin, wherein the sockets are in electrical communication with one another and a first end wall, including a socket receptacle and a second end wall including a socket plug. The sockets in this manner are arranged for an in-line series securement relative to one another for mounting to an exterior surface of a dwelling for example. The housing further includes mounting flanges arranged for mounting of the housing to an underlying surface. A modification of the invention includes translucent lens structure secured to the housing to provide various enhancement to the illumination bulbs mounted within the housing.

U.S. Pat. No. 5,245,519

Inventor: Renato M. Openiano

Issued: Sep. 14, 1993

An ornamental Christmas light decorating system containing one or more clusters of flashing lights, which can be shaped by a user and attached to various surfaces. The clusters provide a perception of directional movement or chasing of light.

U.S. Pat. No. 5,575,098

Inventor: Wei-Kuo Wu

Issued: Sep. 6, 1991

A staged selection type Christmas light controller circuit is provided. The light controller includes a rectifier, a current-limiter, a voltage regulator, a separator, a power stage generator, a selector switch, an oscillator, an integrated circuit controller, a driver, and a plurality of Christmas lights. The rectifier, the current-limiter, and the voltage regulator are connected in series with a power plug for providing DC voltage to the power input pin of the integrated circuit controller. A separator circuit is connected with the output end of the rectifier or the current-limiter and is coupled to the selection trigger pin of the integrated circuit controller through the power stage generator and the selector switch. An oscillator is coupled to the integrated circuit controller and the Christmas light sets are coupled to the controller through a driver. The power stage generator produce a signal for triggering the sequencing of the controller circuit responsive to cycling of the power on and off within a predetermined time period.

U.S. Pat. No. 5,575,098

Inventor: Jeanette C. Goettel-Schwatrz

Issued: Nov. 19, 1996

An illuminated display apparatus includes embossed or quilted indicia artistic and pleasing to small children applied to a generally flat surface that is provided with a plurality of apertures disposed at locations relating to the indicia placed thereon and includes illumination devices extending through the plurality of apertures. A solid state switching device applies electrical power to the illumination devices to energize them. Electrical conductors interconnect the source of electrical energy, the switching device, and the illumination devices, all of which are embedded in a soft sponge-like material sandwiched between a backing material cooperating with the flat surface, sandwiching the electrical components therebetween. The illumination devices may be affixed to a hard frame (valance) or curtain rod for display or may be left unframed where it can function as an illuminated flag, blanket, or wall hanging.

While these illuminated displays may be suitable for the purposes for which they were designed, they would not be as suitable for the purposes of the present invention, as hereinafter described.

SUMMARY OF THE PRESENT INVENTION

A primary object of the present invention is to provide an apparatus for recreating the visual features of a visual image while illuminating the same.

Another object of the present invention is to provide a display apparatus having a plurality of lights extending through the flag display.

Yet another object of the present invention is to provide a display apparatus having a plurality of lights wired into sets of independently controllable lights.

Still yet another object of the present invention is to provide a display apparatus having more than one set of lights.

Another object of the present invention is to provide a display apparatus having a flag mounted on a pliable structure with a plurality of apertures passing therethrough with a plurality of lights mounted therein.

Yet another object of the present invention is to provide a display apparatus having a flag mounted on a housing with a plurality of apertures passing therethrough with a plurality of lights mounted therein.

Still yet another object of the present invention is to provide a display apparatus having an illumination controller for turning the display apparatus on and off.

Another object of the present invention is to provide a display apparatus having an illumination controller for varying the duration, timing, intensity and sequencing of the lights or sets of lights.

Yet another object of the present invention is to provide a display apparatus having an illumination controller for varying the duration of illumination of one or more sets of lights.

Still yet another object of the present invention is to provide a display apparatus having a flag mounted on a structure with a plurality of lights passing therethrough and arranged to complement the design of the flag.

Additional objects of the present invention will appear as the description proceeds.

The present invention overcomes the shortcomings of the prior art by providing an apparatus for displaying a flag or other visual image by recreating and illuminating its visual features. The lighted flag of the present invention is comprised of a flag mounted on a structure having a plurality of apertures therein with a plurality of illumination devices having bulb portions passing therethrough. The illumination is operated by a controller for varying the duration of illumination of the lights that can be arranged in sets with the illumination control device varying the duration of illumination of each light bulb and each set, as well as, sequencing the bulbs within each set. A set being defined as a plurality of lights having common wiring for light operation independent from other sets.

My invention provides a display apparatus adapted to receive electric power from an electric power source, comprising; a plurality of illumination devices, the devices giving light when electrically powered, the devices being in electric communication with the electric power source; and a substantially planar element having a visual image thereon, the visual image having at least two visual features, the planar element having apertures, the apertures being closely aligned with each of the visual features, each of the apertures having one of the illumination devices positioned therein, the number and spacing of the illumination devices being sufficient to substantially recreate the visual features of the visual image, while simultaneously illuminating the visual features.

In one embodiment, the planar element is flexible, the apparatus further comprising a mounting structure for mounting the planar element thereon, the mounting structure having apertures corresponding with the planar element apertures.

In one embodiment, the illumination devices are supported by sockets attached to the mounting structure.

In one embodiment, the sockets are attached to the mounting structure by frictional fit in the mounting structure apertures.

In one embodiment, the illumination devices have sockets, the sockets being attached to the mounting structure by frictional fit within the mounting structure apertures.

In one embodiment, the illumination devices have sockets, the sockets being attached to the mounting structure by adhesive bonding to the mounting structure proximate the mounting structure apertures.

In one embodiment, the illumination devices are attached to the mounting structure by frictional fit in the mounting structure apertures.

In one embodiment, the mounting structure is enclosed.

In one embodiment, the planar element is of sufficient rigidity to support the illumination devices and maintain a generally planar shape.

In one embodiment, the illumination devices arc attached to the planar element by frictional fit in the planar element apertures.

In one embodiment, the illumination devices have sockets, the sockets being attached to the planar element by frictional fit in the planar element apertures.

In one embodiment, the illumination devices have sockets, the sockets being attached to the planar element by adhesive bonding to the planar element proximate the planar element apertures.

In one embodiment, the illumination devices are supported by sockets attached to the planar element.

In one embodiment, each of the illumination devices is supported by a tight fit within one of the planar element apertures.

In one embodiment, the illumination devices in at least one of the visual features are powered independently of the other illumination devices.

In one embodiment, the apparatus further comprises a controller for controlling the electric power to the illumination devices.

In one embodiment, the controller causes at least one of the illumination devices to flash.

In one embodiment, the controller causes at least one of the illumination devices to vary in illumination intensity.

In one embodiment, the controller causes at least one of the illumination devices to be sequentially illuminated, the sequencing being repeated.

In one embodiment, the controller causes at least one of the illumination devices to be sequentially illuminated, the sequencing being coordinated among the illumination devices in the at least two visual features.

In one embodiment, the illumination devices are colored.

In one embodiment, the illumination devices are colored to complement the underlying visual feature.

In one embodiment, the apparatus further comprises a frame about the planar element perimeter.

In one embodiment, the frame further comprises apertures, and the apparatus further comprises illumination devices positioned in the frame apertures.

In one embodiment, one visual feature is a group of stars, with each star having one of the apertures and one of the illumination devices.

In one embodiment, the planar element further comprises a plurality of apertures forming a perimeter about the visual feature that is the group of stars, each aperture having an illumination device therein.

In one embodiment, the apparatus further comprises a controller for controlling the electric power to the illumination devices in the perimeter.

In one embodiment, one visual feature is a plurality of stripes, with each stripe having a number of the apertures spaced along its length in linear fashion and each such aperture has one of the illumination devices.

In one embodiment, the visual image is the United States of America flag as of the year 2002 A.D.

In one embodiment, the apparatus further comprises a base and pole, the planar element being affixed to the pole, the pole being affixed to the base.

In one embodiment, the pole is automatically rotatable within the base.

In one embodiment, the apparatus further comprises: a second plurality of illumination devices, the devices giving light when electrically powered, the devices being in electric communication with the electric power source; and a second substantially planar element having a visual image thereon, the visual image having at least two visual features, the planar element having apertures, the apertures being closely aligned with each of the visual features, each of the apertures having one of the illumination devices positioned therein, the number and spacing of the illumination devices being sufficient to substantially recreate the visual features of the visual image, while simultaneously illuminating the visual features, such second planar element being attached to the first planar element such that the two visual images face in opposite directions.

There is provided a display apparatus adapted to receive electric power from an electric power source, comprising, a substantially planar element having a visual image thereon, the visual image having at least two visual features; and means for recreating the visual features of the visual image by illumination devices, while simultaneously illuminating the visual features, the illumination devices being in electrical communication with the electric power source.

In one embodiment, the apparatus further comprising flasher means for causing flashing among one or more of the illumination devices.

In one embodiment, the apparatus further comprising dimmer means for causing varying illumination intensity among one or more of the illumination devices.

In one embodiment, the apparatus further comprising sequencing means for causing sequential initiation of the illumination devices.

In one embodiment, the apparatus further comprising means for powering the illumination devices for at least one of the visual features independently of the other illumination devices.

In one embodiment, the apparatus further comprising means for powering the illumination devices for each of the visual features independently of the other illumination devices.

In one embodiment, the visual image is the United States flag as of the 2002 A.D.

There is provided a display apparatus adapted to receive electric power from an electric power source, comprising; a plurality of illumination devices, the devices giving light when electrically powered, the devices being in electric communication with the electric power source; and a substantially planar element having a visual image of the United States flag as of 2002 A.D. thereon, the visual image having a first visual feature consisting of fifty stars, with each star having one aperture extending through the planar element, and a second visual feature consisting of a plurality of alternating red and white horizontal stripes, with each stripe having a number of the apertures spaced along its length in linear fashion and extending through the planar element, the apertures in the first and second visual features being closely aligned with each of the visual features, each of the apertures having one of the illumination devices positioned therein, the number and spacing of the illumination devices being sufficient to substantially recreate the visual features of the visual image, while simultaneously illuminating the visual features, the planar element also having a plurality of apertures forming a perimeter about the fifty stars, each aperture in the perimeter having an illumination device positioned therein, the planer element further being flexible; a mounting structure for mounting the planar element thereon, the mounting structure having apertures corresponding with the planar element apertures, the illumination devices being attached to the mounting structure by frictional fit in the mounting structure apertures, the mounting structure being enclosed; and a controller for selectively controlling the electric power to at least one of the illumination devices by, both singularly and in various combinations: independently powering the illumination devices; independently powering groups of the illumination devices; causing at least one of the illumination devices to flash; causing at least one group of the illumination devices to flash; causing at least one of the illumination devices to vary in illumination intensity; causing at least one group of the illumination devices to vary in illumination intensity; causing at least one group of the illumination devices to be sequentially illuminated, the sequencing being repeated; causing at least one group of the illumination devices to be sequentially illuminated, the sequencing being coordinated among the illumination devices in at least one other group of illumination devices.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DESCRIPTION OF THE REFERENCED NUMERALS

Figure 1:
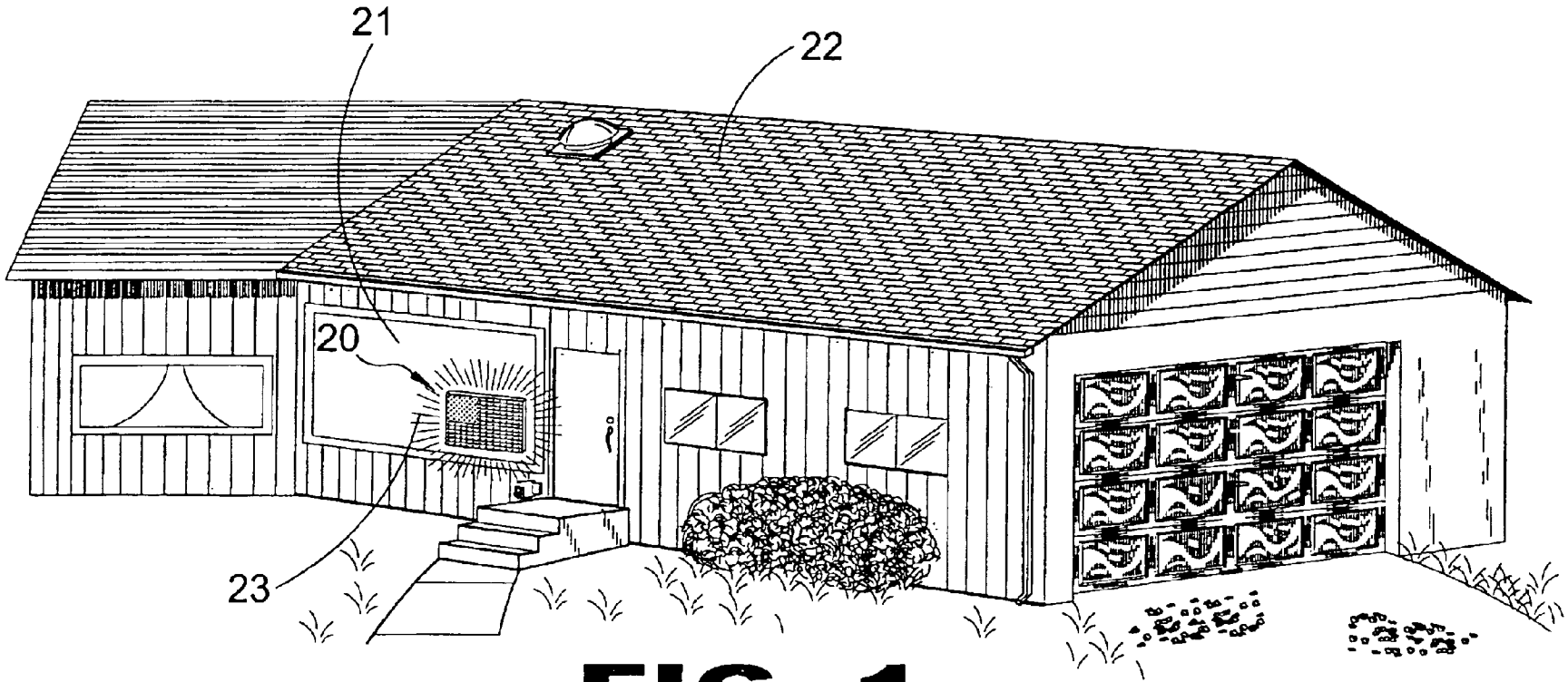
FIG. 1 is a perspective view of the present invention being used in a home picture window.

Turning now descriptively to the drawings, in which similar reference characters denote similar elements throughout the several views, the figures illustrate the present invention. With regard to the reference numerals used, the following numbering is used throughout the various drawing figures.

20 display apparatus of the present invention
21 window
22 home
23 emitted light
30 United States flag (2002 A.D.)
32 star
34 star background
36 red stripe
38 white stripe
40 flag apertures in stripe
42 flag apertures in star
44 flag apertures in star background
50 housing
52 housing front structure
54 housing apertures
60 illumination device
62 illumination device bulb portion
64 illumination device socket portion
66 illumination device controller
68 wiring
70 electrical outlet plug
72 electrical power source
74 sets of lights
76 adhesive
78 housing sides
100 alternate embodiment
102 flag
200 alternate embodiment
202 frame
300 alternate embodiment
302 flag
304 rotating flag pole
306 flag pole base
308 controller and rotation controller
310 back side second visual image

DETAILED DESCRIPTION OF EXEMPLARY EMBODIMENTS OF THE INVENTION

The following discussion describes in detail exemplary embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

The display apparatus 20 of the present invention is ideally positioned on or in proximity to a prominent surface such as the picture window 21 on the home 22 shown in FIG. 1. Emitted light 23 from the display apparatus 20 is presented to the public in a highly prominent manner.

Figure 2:
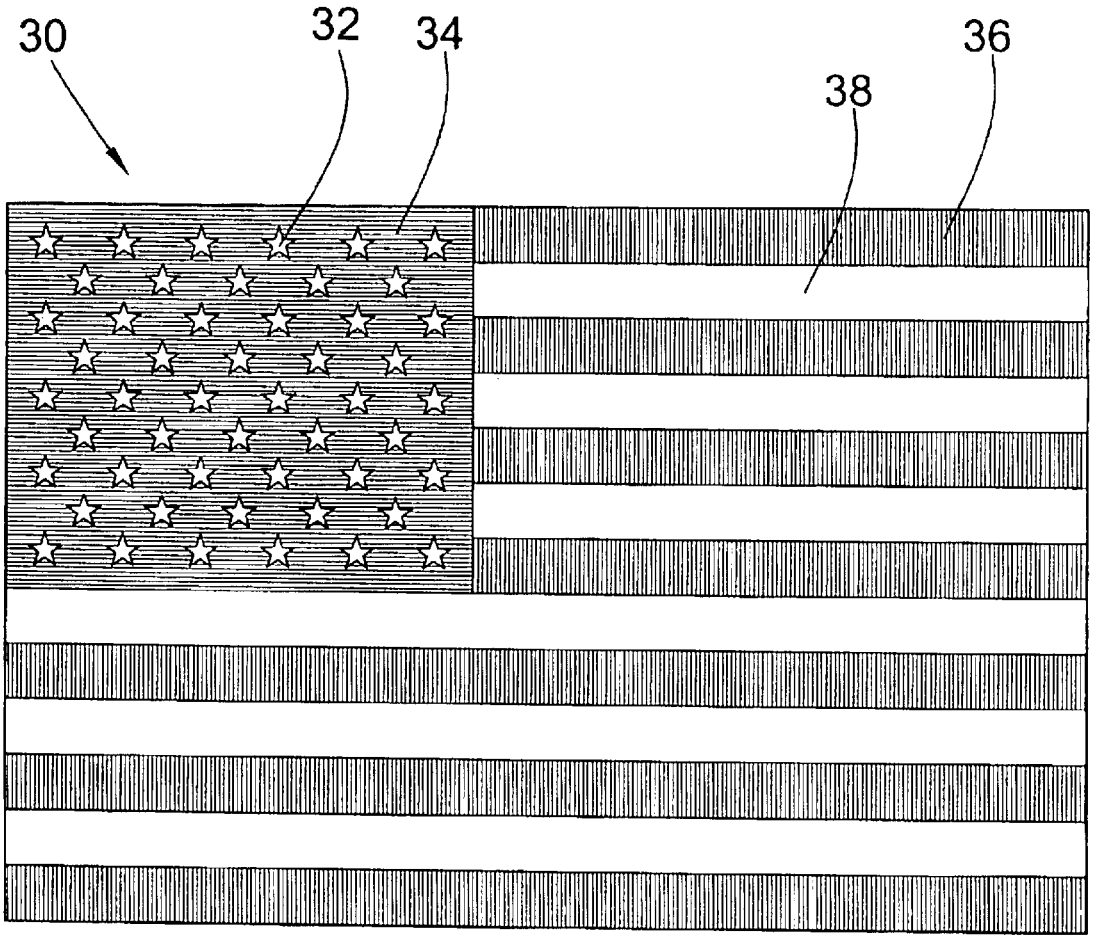
FIG. 2 is a front view of the flag. Shown is the design of the United States flag as of 2002 A.D. The flag can be printed from flexible materials such as fabrics to be attached to a rigid structure with plain front surface. The image of the flag is imprinted on a rigid plane structure or on a ruggedly flexible material.

Although other visual images are suitable for use in the display apparatus 20, the United States flag 30, as of 2002 A.D., is ideally suited for the display apparatus 20 in that the flag 30 has prominent and segregated visual features. As shown in FIG. 2, the visual features include the group of white stars 32 on the blue background 34, as well as, the alternating red stripes 36 and white stripes 38. The flag 30 is usually constructed from a very flexible fabric material.

Figure 3:
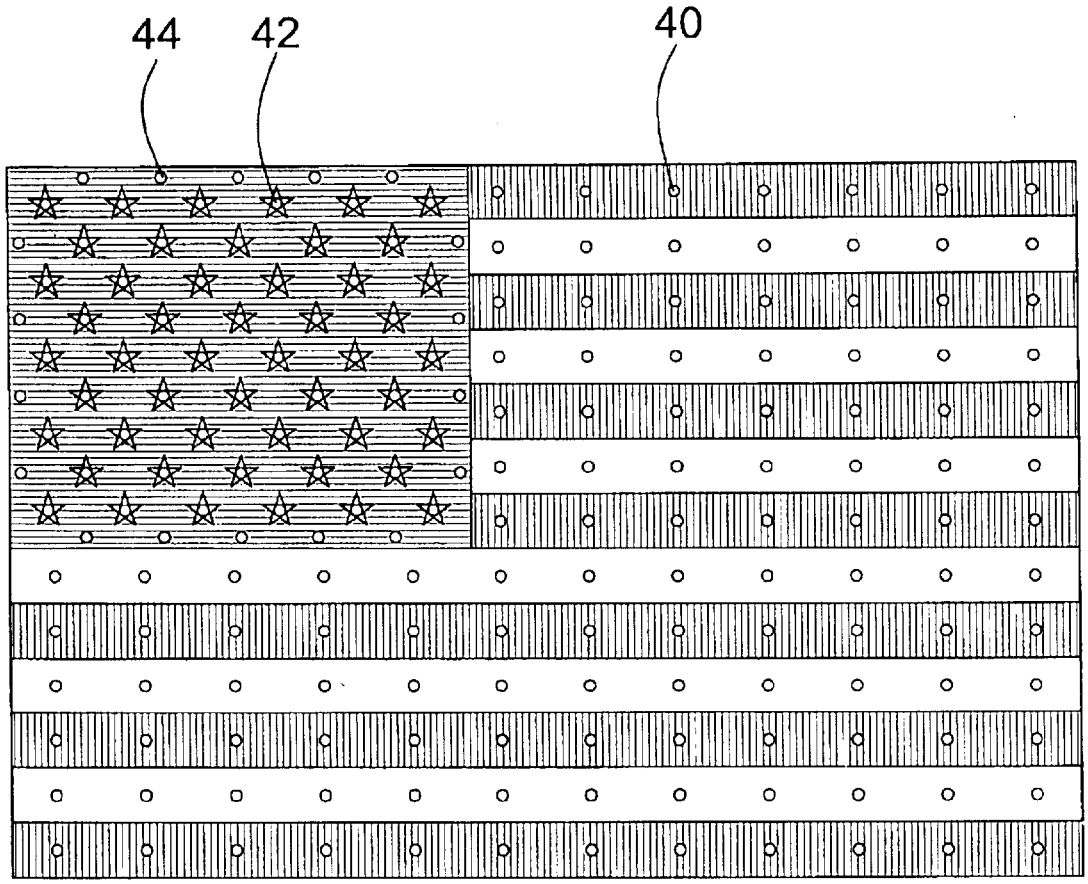
FIG. 3 is a front view of the flag with apertures. Presented is the same flag first shown in FIG. 1 with a pattern of apertures for positioning illumination devices having bulb portions.

As shown in FIG. 3, the display apparatus 20 utilizes the generally planar flag 30 by placing stripe apertures 40 in a linear fashion along the length of the stripe 36,38. Similarly, a star aperture 42 is placed in each star 32 and background apertures 44 are placed to form a perimeter about the stars 32.

Figure 4:
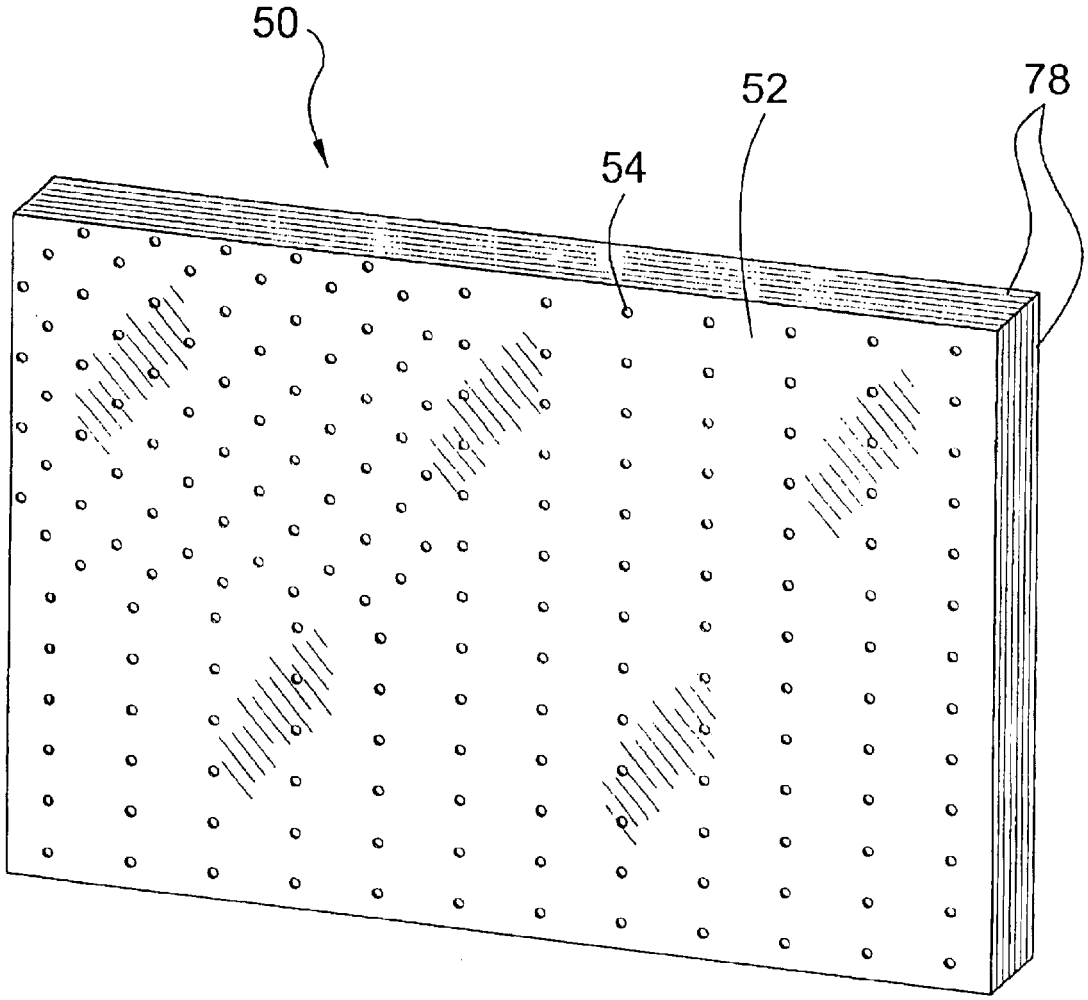
FIG. 4 is a front view of the housing with apertures. The pattern of the apertures matches that of the flag wherein the flag will be attached on the front face of the housing thereby maintaining the visual image of the flag.

When the flag 30 is very flexible, the display apparatus 20 includes a housing 50 for a mounting structure, the housing 50 having a generally planar front member 52 with apertures 54 aligned with the flag apertures 40,42,44. The housing 50 is depicted in FIG. 4.

Figure 9:
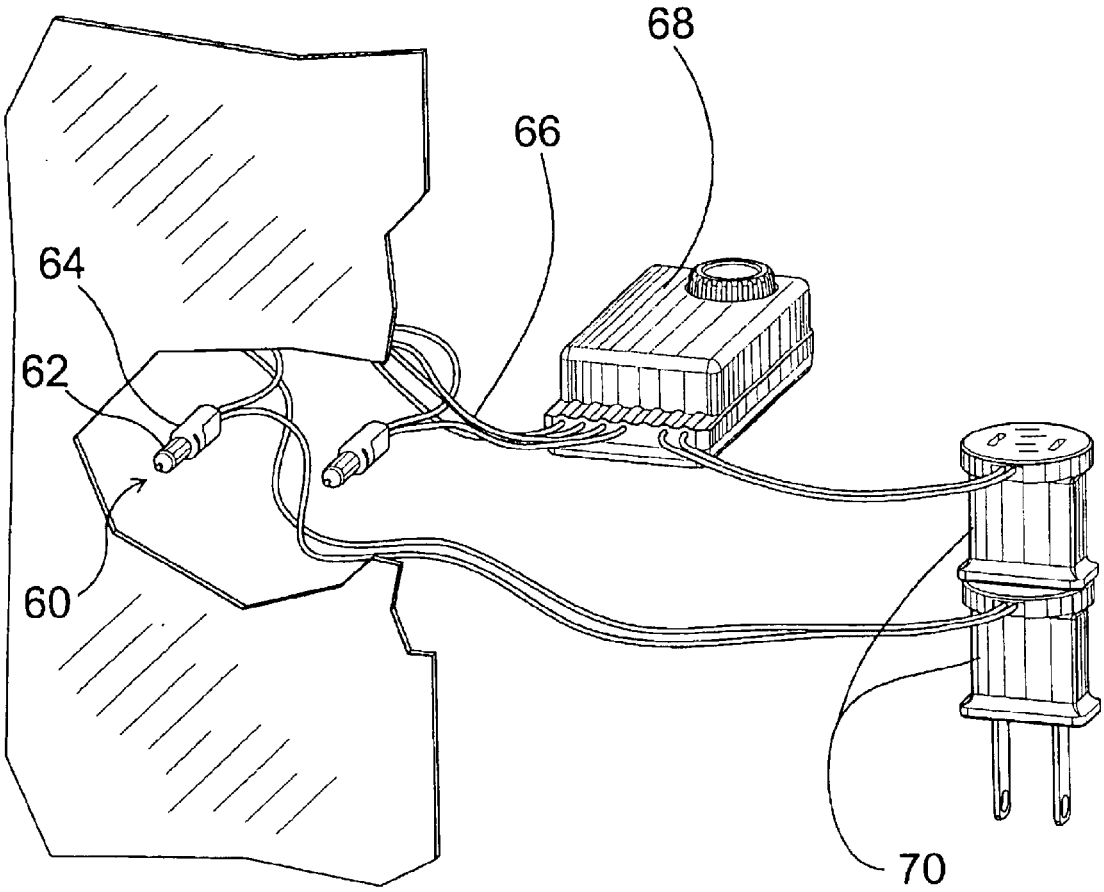
FIG. 9 is a partial sectional view of the present invention. Shown is one wiring arrangement wherein power is supplied to the illumination controller, as well as, directly to the illumination devices.
Figure 10:
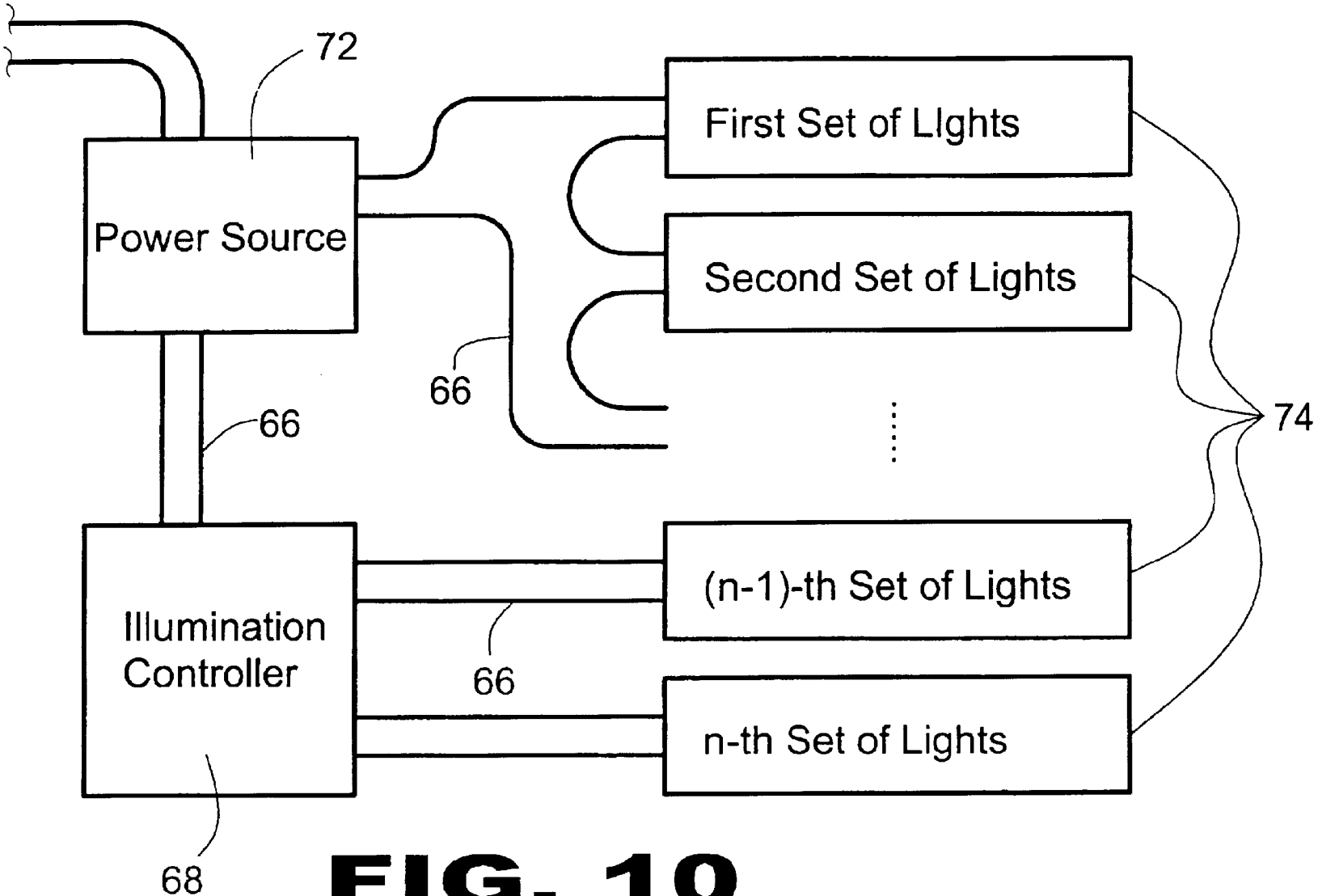
FIG. 10 is a representative view of the wiring. A series of sets of bulbs can have their own simple controllers directly powered from the power source. A more sophisticated illumination control unit can also be employed for sequencing of the lighting of the bulbs in another group of sets of bulbs.

Illumination devices 60 include a bulb portion 62 and a socket portion 64 with conventional wiring 66 establishing electrical communication between the illumination devices 60 (independently or in sets) and with an illumination controller 68 and electrical outlet plugs 70. As shown in FIG. 9 and FIG. 10, the illumination devices 60 are, in various embodiments, wired directly to the electric power source 72 through the outlet plugs 70, or indirectly through the illumination controller 68.

The controller 68 has the ability to coordinate the timing, intensity, and sequencing of the illumination devices 60. The illumination devices 60 can be controlled individually or in sets 74. The number (n) of sets 74 being variable, with the sets 74 being operable through the controller 68, or otherwise, as depicted in FIG. 10.

Figure 11:
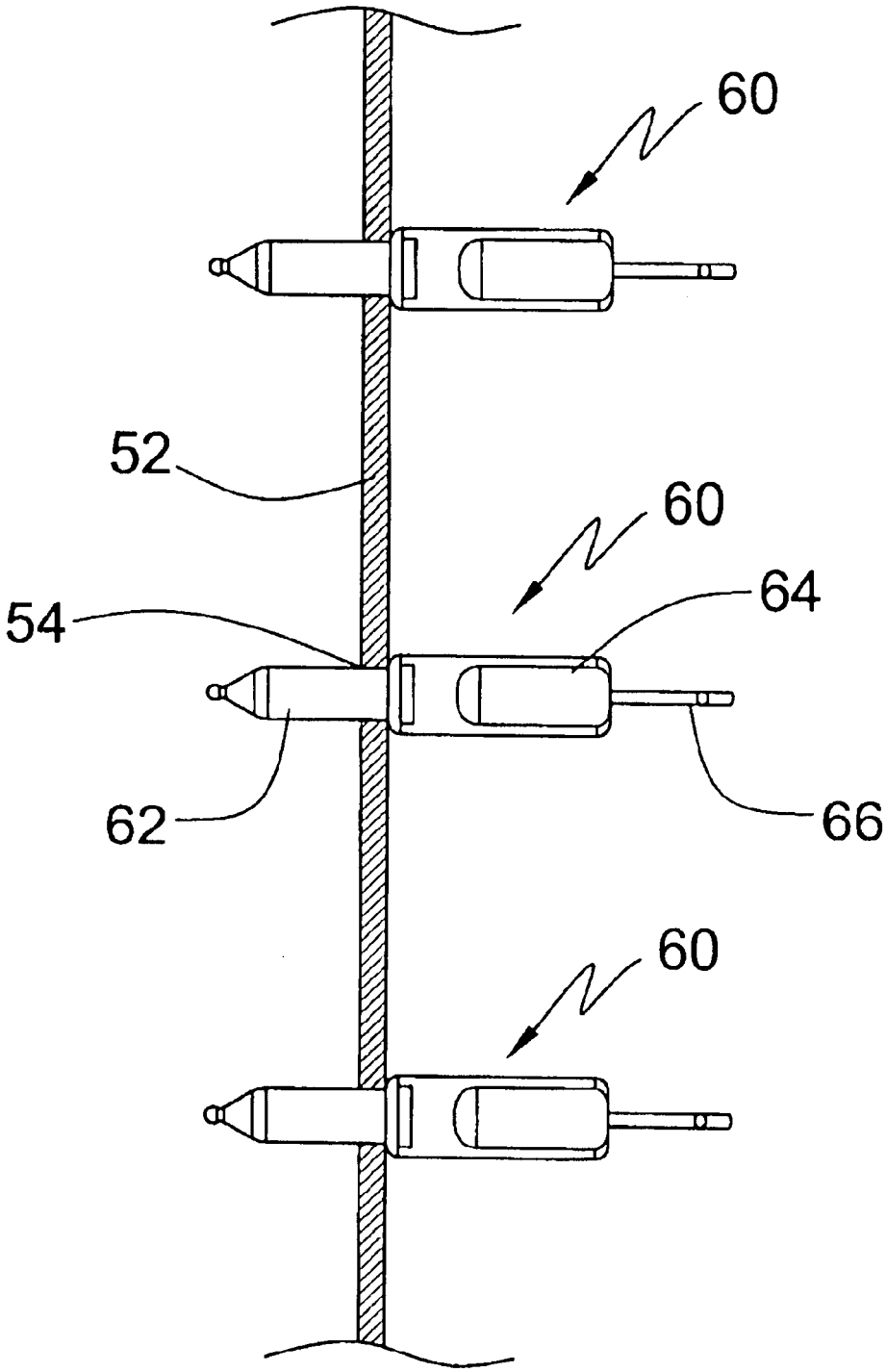
FIG. 11 is a partial sectional view showing one method of mounting the illumination devices.
Figure 12:
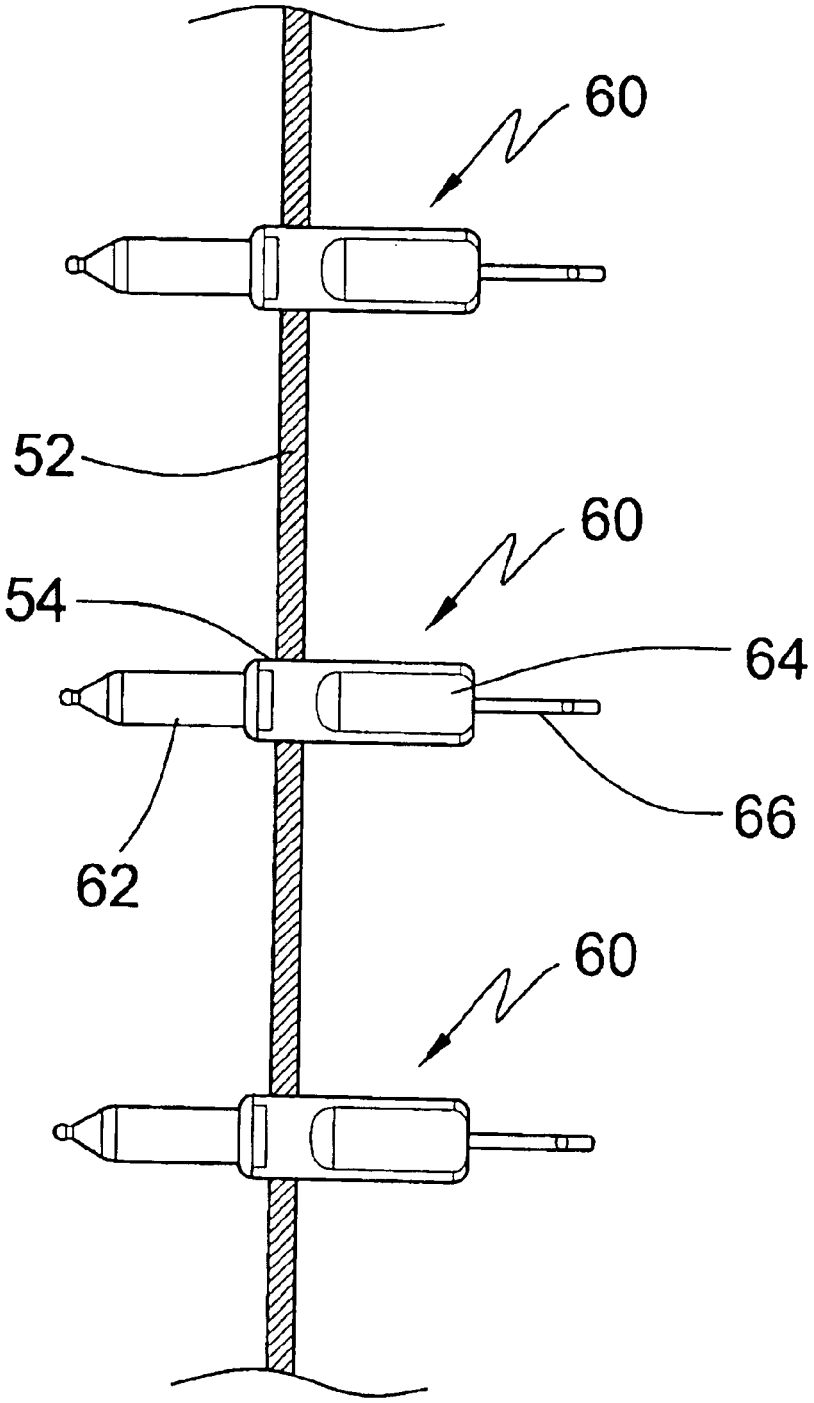
FIG. 12 is a partial sectional view showing an alternate method of mounting the illumination devices. Shown is an alternate method of removably mounting the illumination devices on a rigid structure by having the socket portions frictionally fitted with the apertures of the housing. This method also provides a more durable construction as there is little need to remove the socket portions from the housing.
Figure 13:
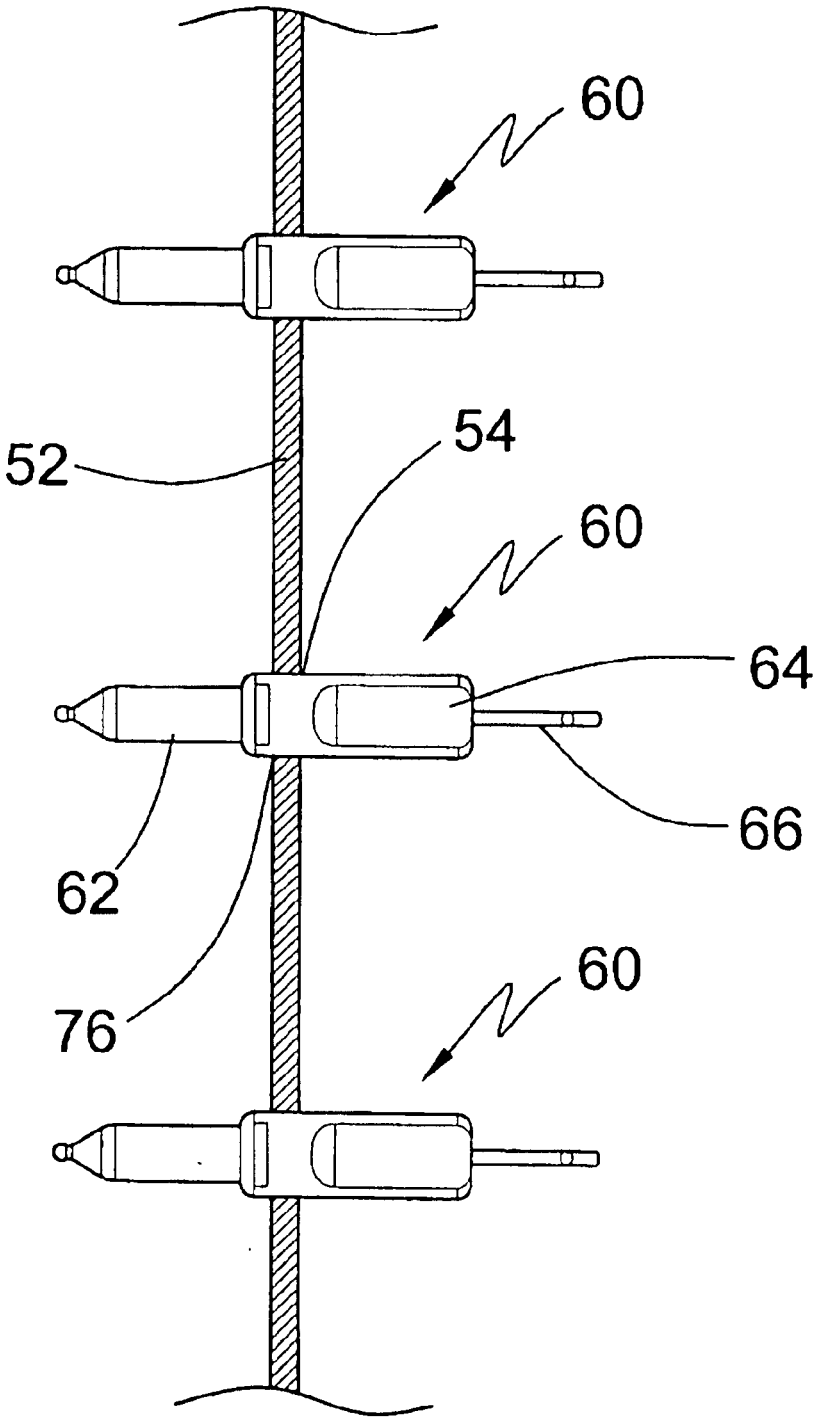
FIG. 13 is a partial sectional view showing another alternate method of mounting the illumination devices, by fitting the socket portions in the apertures on a rigid structure by use of an adhesive materials. This method is made possible due to the fact the socket portion of an illumination device need not be removed in order to replace the bulb. This means of attachment forms the strongest installation of the illumination devices on the rigid structure.

The illumination devices 60 are held within the housing front member apertures 54 by the tight sizing of the bulb 62 in the aperture 54, as shown in FIG. 11. This frictional fit provides a secure attachment of the illumination devices 60 while facilitating relatively easy removal of the illumination devices 60 for later bulb 62 replacement, and for other reasons. In other embodiments, depicted in FIG. 12, the aperture 54 is sized for a similar tight fit with the socket portion 64 of the illumination devices 60. FIG. 13 depicts another embodiment where the socket portion 64 is attached by an adhesive 76 to the housing front member 52 at the aperture 54.

Figure 5:
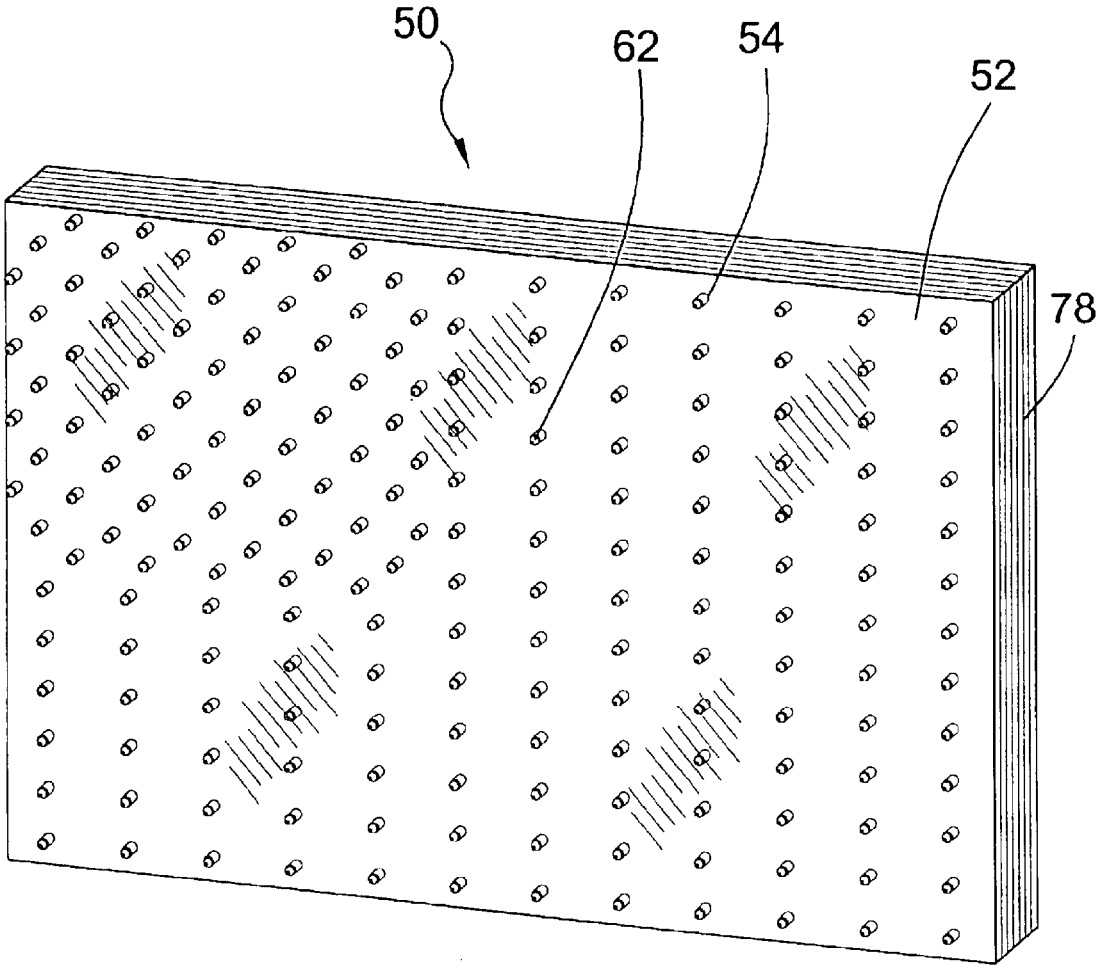
FIG. 5 is a front view of the bulb housing having illumination devices positioned therein. Presented here is the front view of the housing with the bulb portions in place and ready to receive the flag. The flag can be rigidly attached to the face of the housing by various fastening means.
Figure 6:
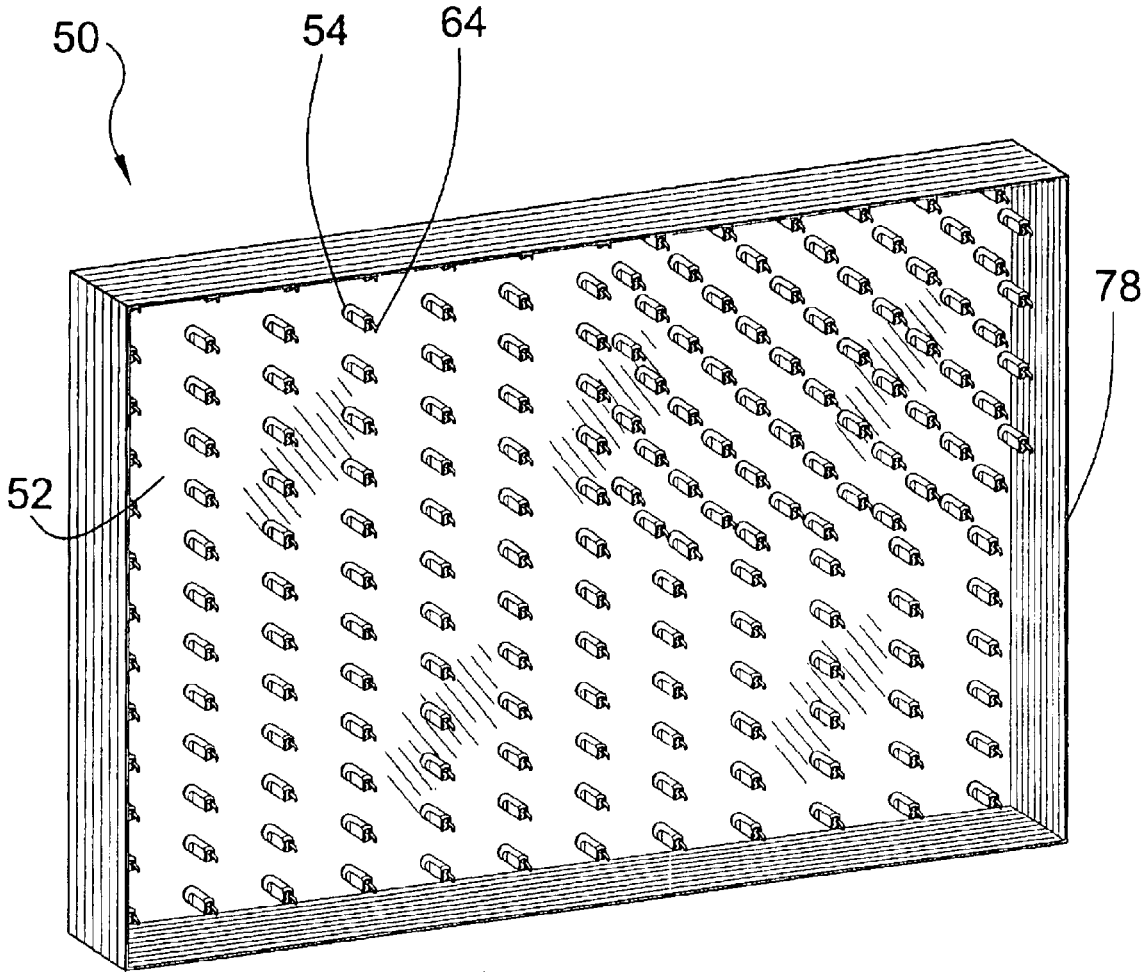
FIG. 6 is the back view of the housing with the illumination devices in position. Shown is the back view of the same housing in FIG. 5 with the back cover removed for viewing. The socket portions of the illumination devices are shown with the wiring removed for a clear view.

The attached illumination devices 60 are shown in FIG. 5 and FIG. 6. FIG. 6 shows the recess formed by the housing sides 78. In some embodiments, a housing back is attached to the housing sides 78 to protect the illumination devices 60 and other components from the elements.

Figure 7:
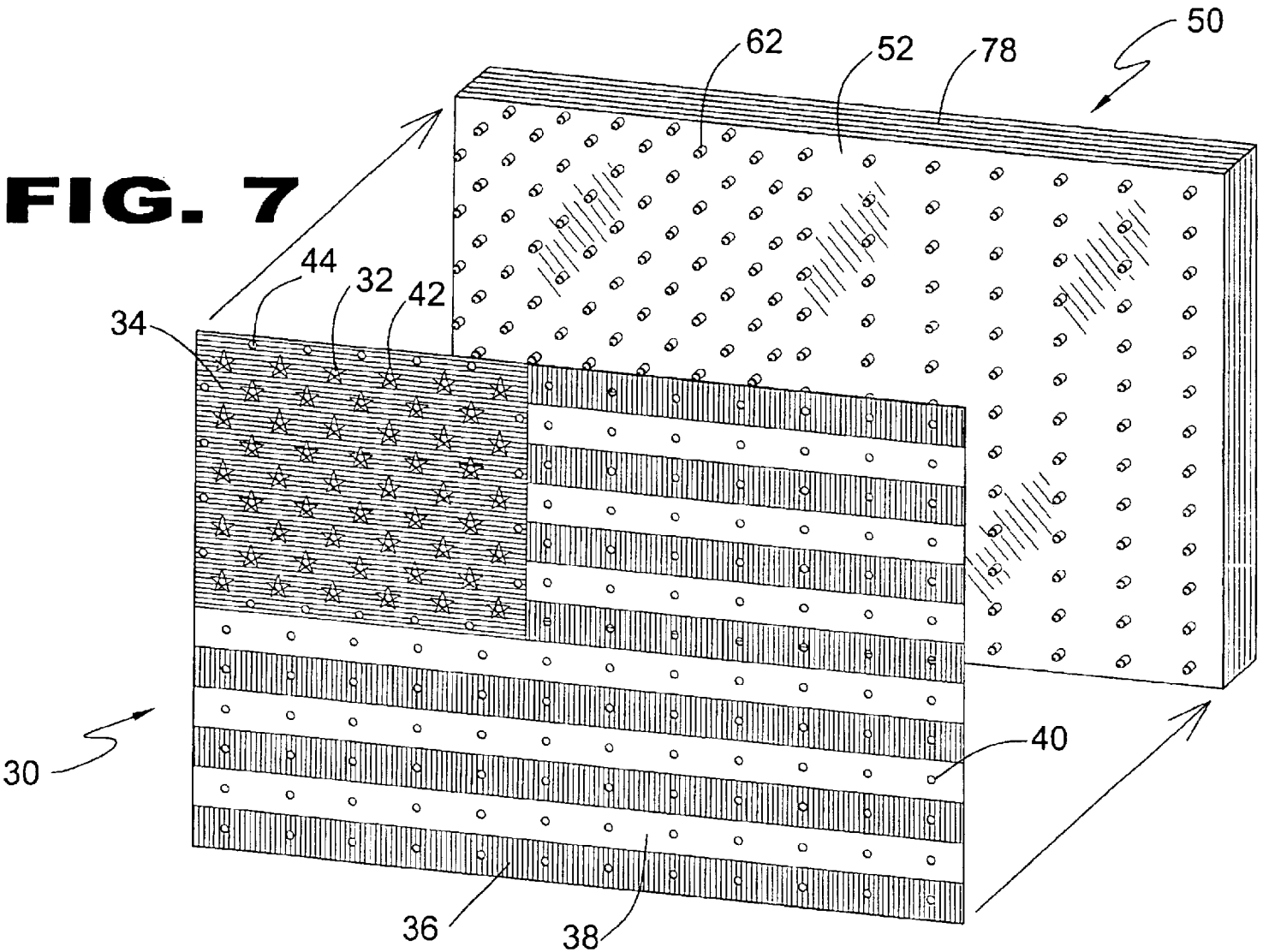
FIG. 7 is a front view of the housing with the flag in position for attachment. Shown are the flag from FIG. 2 and the housing from FIG. 5 and FIG. 6 showing the flag being mounted rigidly on the front face of the housing. The bulb portions pass through the apertures provided on the flag with most of the illumination portion positioned in front of the flag.
Figure 8:
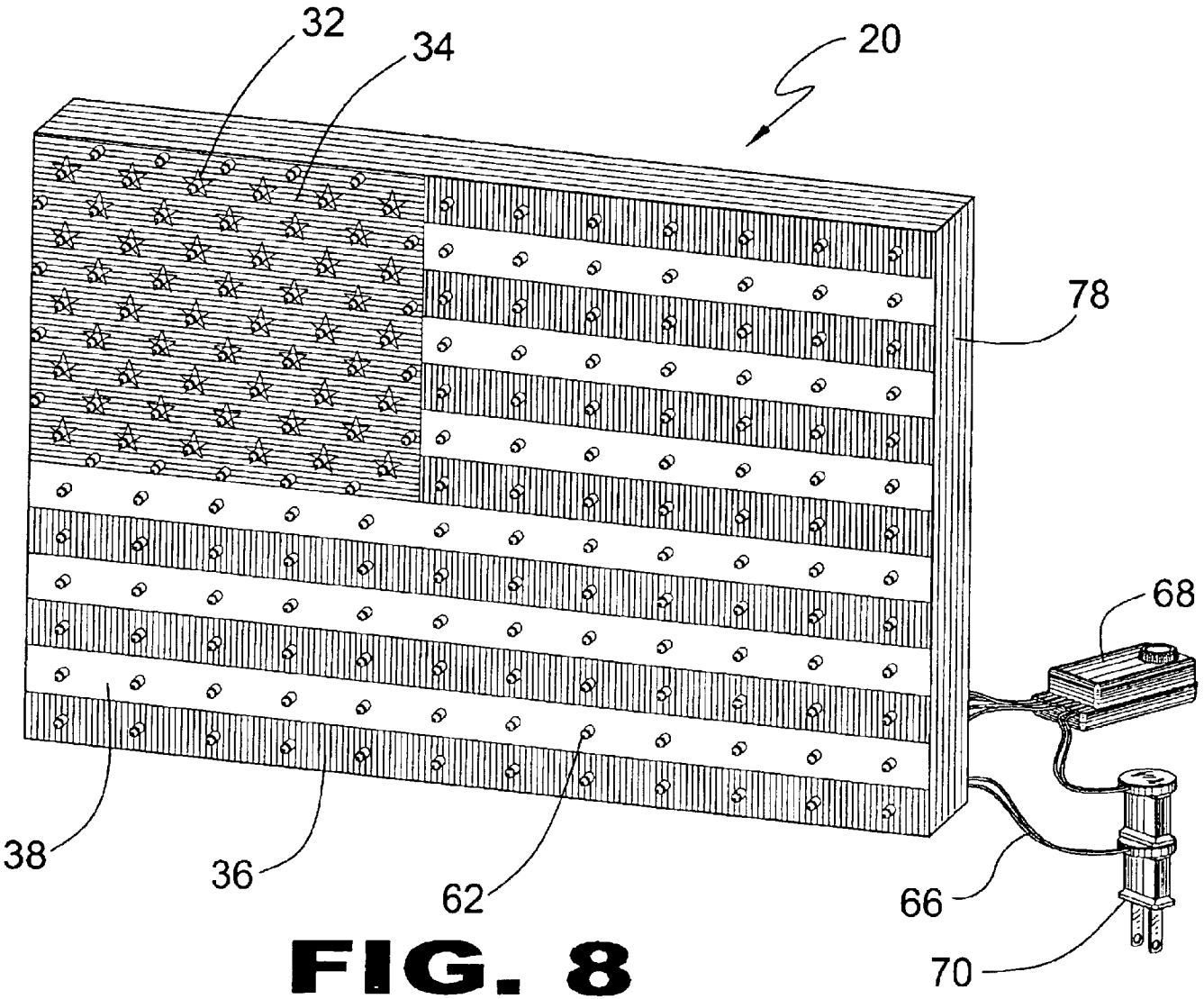
FIG. 8 is a perspective view of the present invention.

FIG. 7 shows the positioning of the flag 30 as it is readied for attachment to the housing front member 52 by threading all the illumination devices 60 through the flag apertures 40,42,44. The attached flag 30 is shown in FIG. 8 with all flag apertures 40,42,44 having received an illumination device 60. The wiring 68 is shown to be of sufficient length to place the controller 68 and outlet plugs 70 at a usable distance from the housing 50.

The display apparatus 20 spaces and positions the illumination devices 60 to recreate the different visual features of the visual image, while simultaneously illuminating such visual features. For example, in the United States flag 30, the grouping of the stars 32 cooperates with the star background 34 to form an easily distinguishable and segregable visual feature, in a matrix form. This visual feature joins with the horizontal stripes 36,38, each of which is a visual feature in its own right. Each stripe 36,38 cooperates with the other stripes 36,38 to suggest a single visual feature that then complements the star group feature within the flag 30 rectangle.

As shown in FIG. 8, the linear placement and spacing of the illumination devices 60 on each horizontal stripe 36,38 recreates, i.e. strongly suggests in a visual sense, the same stripe that it simultaneously illuminates. Similarly, the combination of the illumination devices 60 within each star 32 recreates the star matrix on the flag 30 while simultaneously illuminating that particular visual feature of the overall visual image of the flag 30. In this embodiment, the recreation of the star matrix is accented by forming the perimeter of illumination devices 60 about the star 32 grouping.

Visual feature recreation and illumination is also enhanced by the manipulation of the illumination devices 60 associated with such features using the controller 68. This occurs, for example, when the set of illumination devices 60 associated with the particular visual feature, such as the star matrix, is directed by the controller such that the set is flashed in unison, goes through a dimmer cycle in unison, or has a sequencing pattern that executes independently from the set of illumination devices 60 associated with another visual feature, such as the horizontal stripes.

Similarly, independent, but coordinated execution of such functions among the various visual features contributes to the same end. Embodiments of the present invention include various combinations of such functions among the visual features of the selected visual image.

In other embodiments, the visual feature recreation and illumination is also enhanced by the use of one or more colored illumination devices that either match or complement the underlying visual feature and its color.

Figure 14:
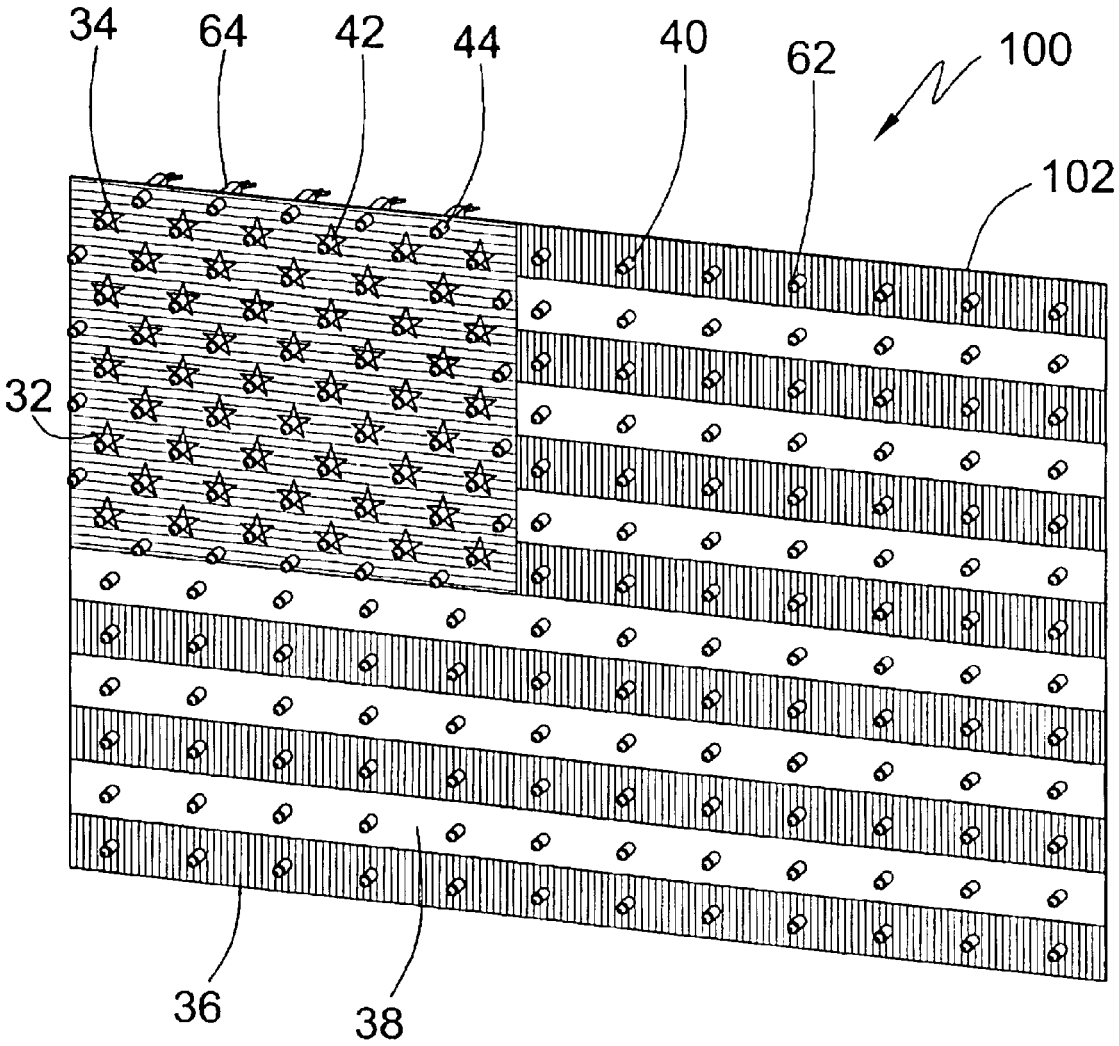
FIG. 14 is a front view of the stand-alone illuminated flag. Shown is a configuration in which the housing is eliminated with the use of a rigid flag structure or else a ruggedly flexible one in which the apertures were provided with proper dimension and supporting strength to support the illumination devices.
Figure 15:
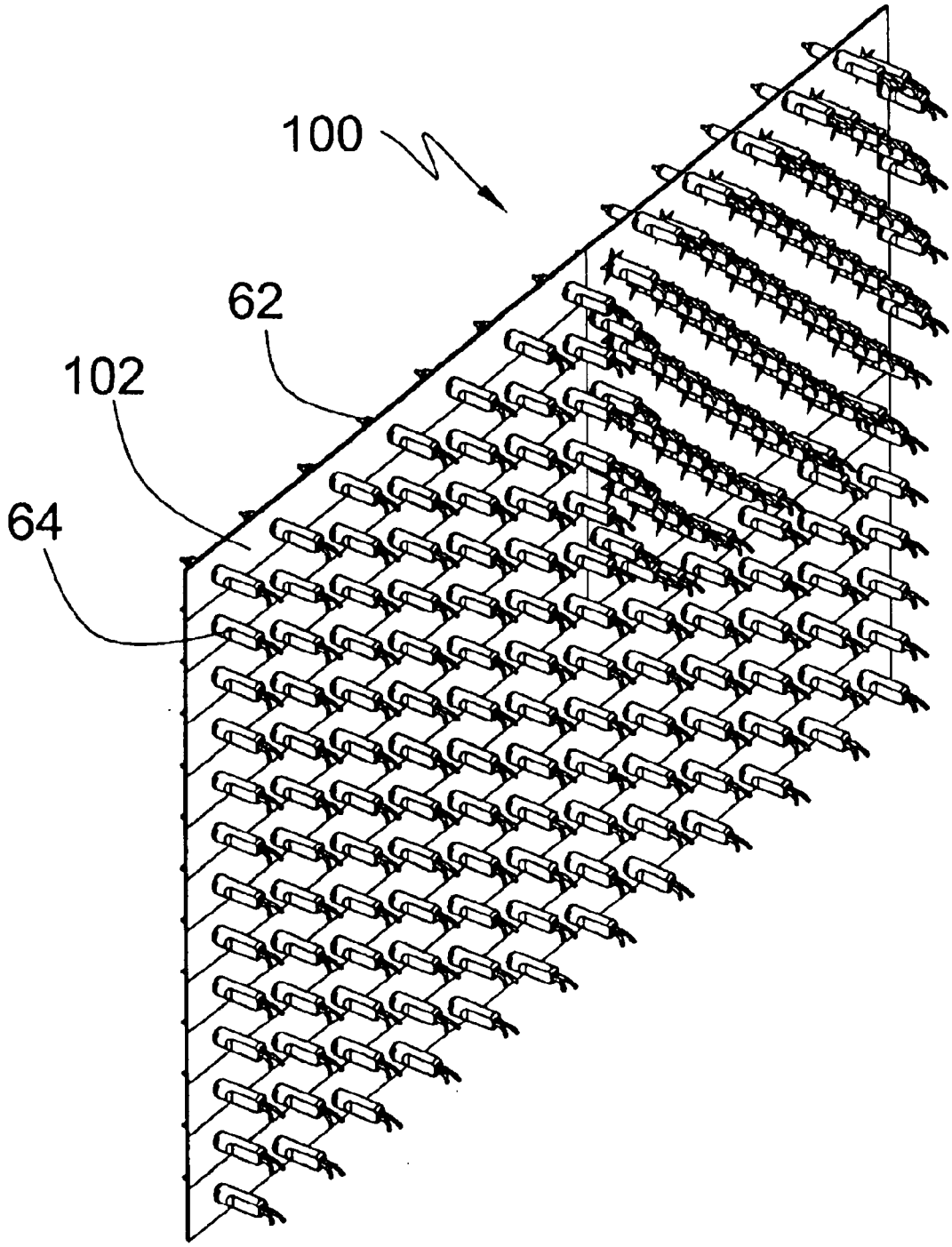
FIG. 15 is a back view of the stand-alone illuminated flag. The back view of the same stand-alone illuminated flag in FIG. 14 is shown with the wiring removed for clear viewing.

In another embodiment 100, shown in FIG. 14 and FIG. 15, the flag 102 is constructed from a material that is ruggedly flexible, having sufficient rigidity to maintain a generally planar shape without the necessity of the housing 50. The flag apertures 40,42,44 are of sufficient width to accommodate the frictional fit of the illumination devices bulb 62 and the illumination devices socket 64, as well as, the adhesive attachment of the illumination devices socket 64. In other embodiments, the material is rigid.

Figure 16:
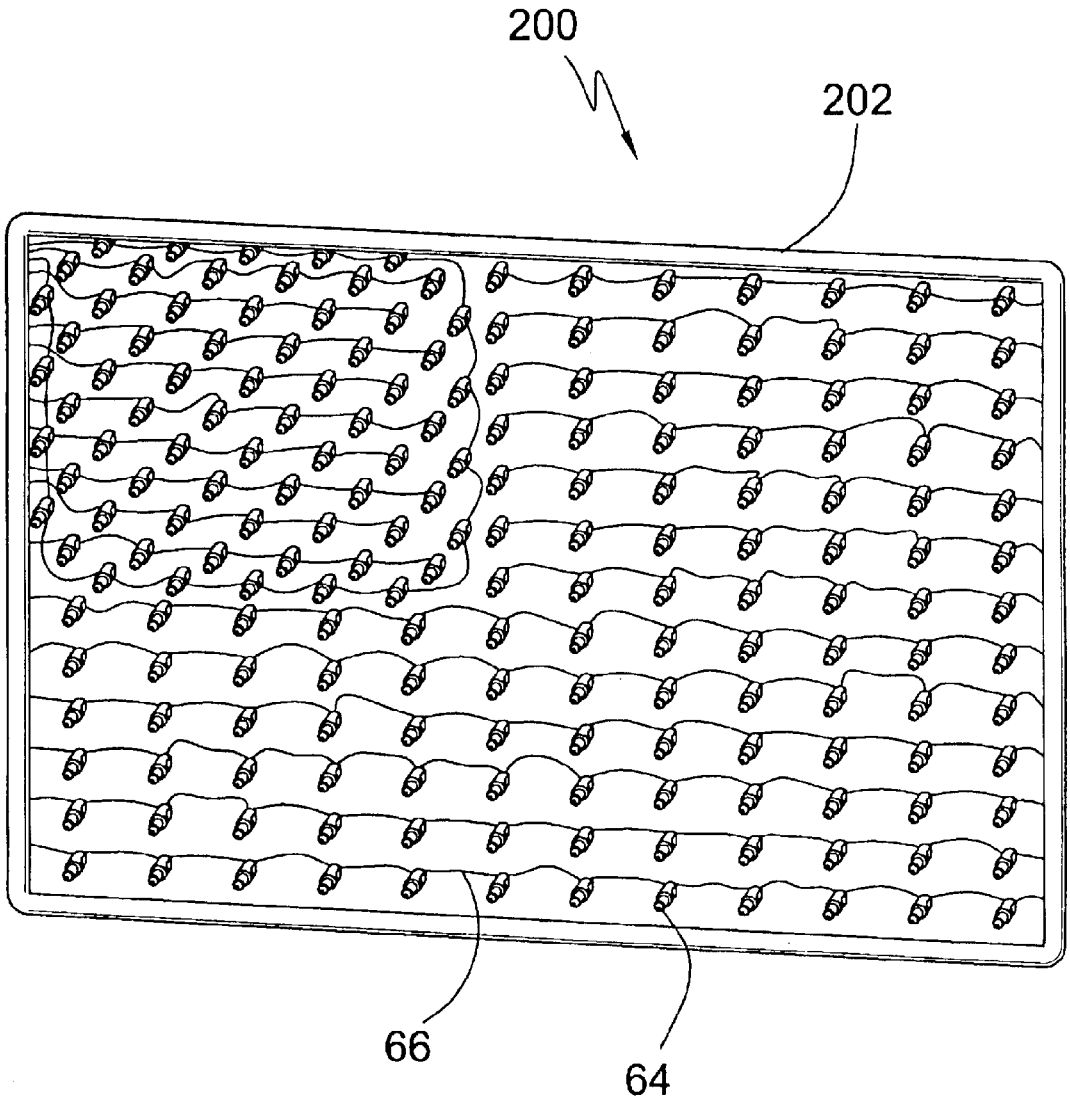
FIG. 16 is an alternative embodiment of the present invention where the flag is within a frame.

FIG. 16 depicts another embodiment 200 where the flag 30,102 is encompassed by a conventional frame 202. In other embodiments, the frame 202 is a visual feature for which illumination devices 60 are positioned in frame apertures.

Figure 17:
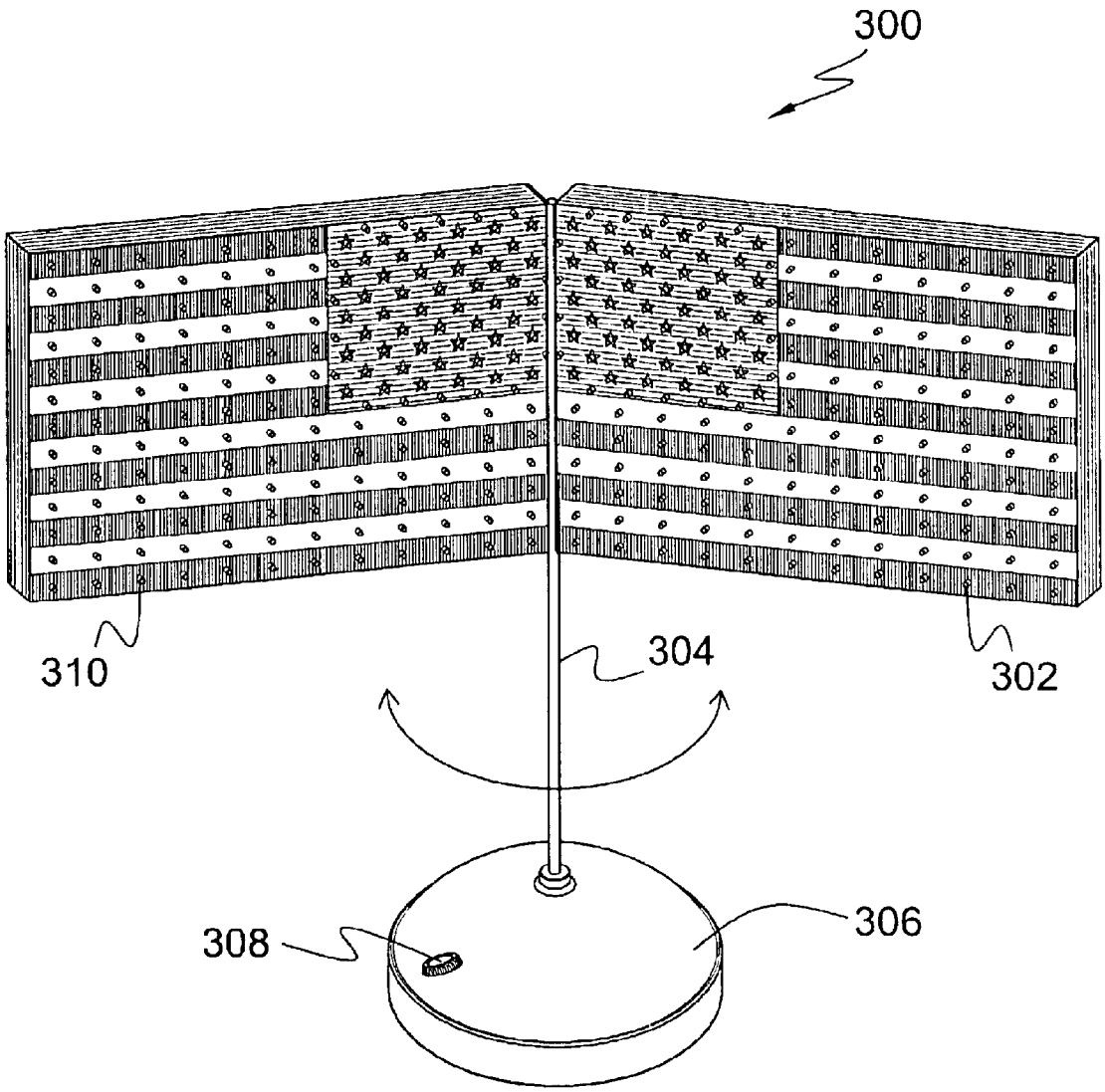
FIG. 17 is another alternative embodiment of the present invention. Shown is the flag illumination of the present invention mounted on a pole having a base with a motor contained therein whereby the flag will continuously rotate. The flag can have a front and a back with different flags portrayed on each side.

Another embodiment 300 is shown in FIG. 17, where the display apparatus 302 is mounted on a pole 304 held in place and rotated by a base 306, with a motor, using conventional motorized rotational means. The controller and rotation controls 308 are positioned on the base 306. In other embodiments, a second visual image 310 is attached to the other side of the display apparatus 302. The second visual image is another flag in some embodiments, the second flag being a new flag, the United States flag, or the "back" view of the United States flag, i.e. the star matrix is on the right.

With respect to the above description then, it is to be realized that the optimum material and dimensional relationships for the parts of the display apparatus 20, will include variations in size, materials, shape, and form, which will occur to those skilled in the art upon review of the present disclosure. For example, the housing 50 and rigid flag 102 are, in various embodiments, constructed from various woods, metals, glasses and plastics.

Furthermore, the illumination devices 60 include various wired bulbs and lights typically used in home decorations, and these are of many shapes, with some having bulbs removable from the socket, in which case the sockets are attached to the housing front member, or the stiff flag, as the case may be.

In some embodiments, the controller 68 is mounted on the housing 50 and the power source is battery-powered, and is direct or alternating current. The controller 68 includes on-off and timer functions in some embodiments.

All equivalent relationships to those illustrated in the drawings and described in the specification are intended to be encompassed by the present invention.

What is claimed as new and desired to be protected by Letters Patent is set forth in the appended claims:

1. A display apparatus adapted to receive electric power from an electric power source, comprising;

a plurality of illumination devices, the devices giving light when electrically powered, the devices being in electric communication with the electric power source; and a substantially planar element having a visual image of the United States flag as of 2002 A.D. thereon, the visual image having a first visual feature consisting of fifty stars, with each star having one aperture extending through the planar element, and a second visual feature consisting of a plurality of alternating red and white horizontal stripes, with each stripe having a number of the apertures spaced along its length in linear fashion and extending through the planar element, the apertures in the first and second visual features being closely aligned with each of the visual features, each of the apertures having one of the illumination devices positioned therein, the number and spacing of the illumination devices being sufficient to substantially recreate the visual features of the visual image, while simultaneously illuminating the visual features, the planar element also having a plurality of apertures forming a perimeter about the fifty stars, each aperture in the perimeter having an illumination device positioned therein, the planer element further being flexible;

a mounting structure for mounting the planar element thereon, the mounting structure having apertures corresponding with the planar element apertures, the illumination devices being attached to the mounting structure by frictional fit in the mounting structure apertures, the mounting structure being enclosed; and a controller for selectively controlling the electric power to at least one of the illumination devices by, both singularly and in various combinations:

independently powering the illumination devices;

independently powering groups of the illumination devices;

causing at least one of the illumination devices to flash;

causing at least one group of the illumination devices to flash;

causing at least one of the illumination devices to vary in illumination intensity;

causing at least one group of the illumination devices to vary in illumination intensity;

causing at least one group of the illumination devices to be sequentially illuminated, the sequencing being repeated;

causing at least one group of the illumination devices to be sequentially illuminated, the sequencing being coordinated among the illumination devices in at least one other group of illumination devices.

2. The apparatus of claim 1, wherein the illumination devices are supported by sockets attached to the mounting structure.

3. The apparatus of claim 1, wherein the planar element is of sufficient rigidity to support the illumination devices and maintain a generally planar shape.

4. The apparatus of claim 1, wherein the apparatus further comprises a frame about the planar element perimeter.

5. The apparatus of claim 4, wherein the frame further comprises apertures, and the apparatus further comprises illumination devices positioned in the frame apertures.

6. The apparatus of claim 1, wherein the apparatus further comprises a base and pole, the planar element being affixed to the pole, the pole being affixed to the base.

7. The apparatus of claim 6, wherein the pole is automatically rotatable within the base.

* * * * *